United States Patent [19]

Benoit

[11] Patent Number: 4,768,240

[45] Date of Patent: Sep. 6, 1988

[54] PIVOTABLE FOOT BOARD FOR NURSING HOME BED

[75] Inventor: Roland A. Benoit, Danielson, Conn.

[73] Assignee: Gem Industries, Inc., Gardner, Mass.

[21] Appl. No.: 875,719

[22] Filed: Jun. 18, 1986

[51] Int. Cl.[4] ..... A61G 7/00

[52] U.S. Cl. ..... 5/53 C; 5/53 R; 5/60; 5/66; 5/424

[58] Field of Search ..... 5/60, 53 R, 53 C, 53 B, 5/53 D, 425, 428, 430, 66, 183, 184, 202, 280, 424; 297/463

[56] References Cited

U.S. PATENT DOCUMENTS

| | | | |
|---|---|---|---|
| 272,077 | 2/1883 | Mueller | 5/183 |
| 1,885,812 | 11/1952 | Fichtenbaum | 5/53 C |
| 2,029,705 | 2/1936 | Dewey | 5/53 D |
| 2,146,970 | 2/1939 | McGrew | 5/53 R |
| 2,370,890 | 3/1945 | Thomas | 5/53 R |
| 2,538,993 | 1/1951 | Travis | 5/66 |
| 2,666,213 | 1/1954 | Bash | 5/53 R |
| 2,701,374 | 2/1955 | Hillenbrand et al. | 5/280 X |
| 3,821,821 | 7/1974 | Burst et al. | 5/66 X |
| 3,839,753 | 10/1974 | Benoit et al. | 5/66 X |
| 3,965,500 | 6/1976 | Stein, Jr. | 5/66 X |
| 3,972,081 | 8/1976 | Stern et al. | 5/60 X |
| 4,097,939 | 7/1978 | Peck et al. | 5/66 X |
| 4,110,856 | 9/1978 | Benoit et al. | 5/66 X |
| 4,411,035 | 10/1983 | Fenwick | 5/66 X |
| 4,509,217 | 4/1985 | Therrien | 5/428 X |

FOREIGN PATENT DOCUMENTS

| | | | |
|---|---|---|---|
| 1027703 | 3/1978 | Canada | 5/66 |
| 392245 | 5/1933 | United Kingdom | 5/53 B |
| 2038617 | 7/1980 | United Kingdom | 5/66 |

*Primary Examiner*—Alexander Grosz

*Attorney, Agent, or Firm*—Charles R. Fay

[57] ABSTRACT

Manually operated foot board to selectively conceal or expose hand cranks for mattress adjustment in a nursing home bed.

8 Claims, 3 Drawing Sheets

PIVOTABLE FOOT BOARD FOR NURSING HOME BED

FIELD OF THE INVENTION

This invention relates to an appliance or adjunct to a nursing home bed having at least one but usually three hand cranks at the foot of the bed, for adjusting the mattress by varying the parts of the support spring for the mattress. The invention resides in means to conceal these cranks from view, but very easily rendering them visible and operable.

BACKGROUND OF THE INVENTION

Nursing homes usually use hand cranked mattress adjustment beds, but the invention also applies to any bed that has hand cranks located in a place where it is desirable to conceal them and thus lessen the immediate indication that the person using the bed is an invalid or at least ill. With the present invention in use, the bed more nearly appears to be perfectly ordinary, except when it is desired to make an adjustment. Often, the adjustments are very few and far between, but in the prior art, the hand cranks are very obvious, and are right out in plain view.

SUMMARY OF THE INVENTION

The principal parts of the bed under consideration herein are old and well-known. The legs, frame, spring, mattress and hand cranked adjustment devices are all old, and very little disclosure thereof is necessary. The hand cranks are conventional and are of the type that can be disjointed from the shafts they turn, to hang down out of operating position to be more or less out of the way but still attached to the shafts. Even though thus out of the way, so to speak, they are still very visible, while the rest of the mattress adjusting mechanism is of course hidden under the mattress.

The novel means concealing the cranks is essentially a vertically movable foot board. This foot board appears to be just like any foot board, but is so mounted on the bed frame that it can be pulled up to reveal the hand cranks normally concealed behind the foot board in its down, normal position. The foot board is mounted at its ends on parallel linkages that are spring loaded (past dead center) to hold the foot board temporarily up during the hand operated mattress adjustment, but once the cranks are disjointed and hang down, the foot board is very easily merely pushed down to normal concealment position.

When the cranks are disjointed, they hang down loosely with parts in the path of motion of the foot board, which swings them back, in under the mattress and spring, and holds them in that position, against gravity. When the foot board is pulled up, the cranks thus automatically swing out into position where they can be easily grasped, re-jointed to their shafts, and operated for their intended purpose.

PREFERRED EMBODIMENT OF THE INVENTION

Figure 1:
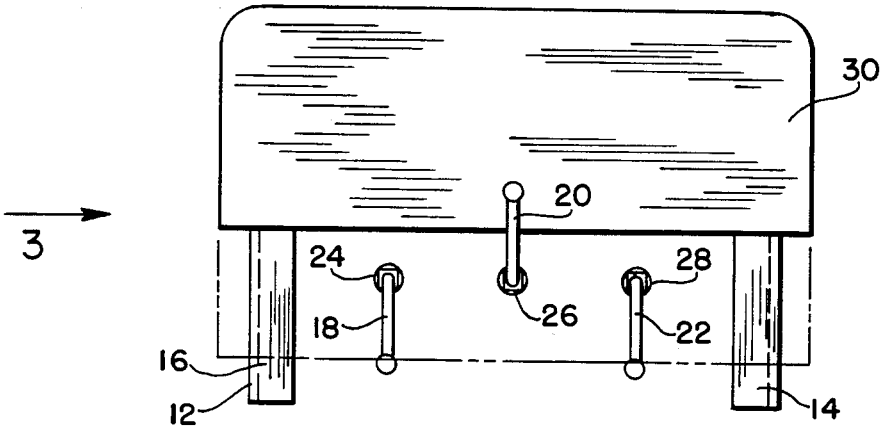
FIG. 1 is a front elevational view of a nursing home bed showing the crank concealing foot board in raised position to allow the cranks to be operated, part broken away.
Figure 2:
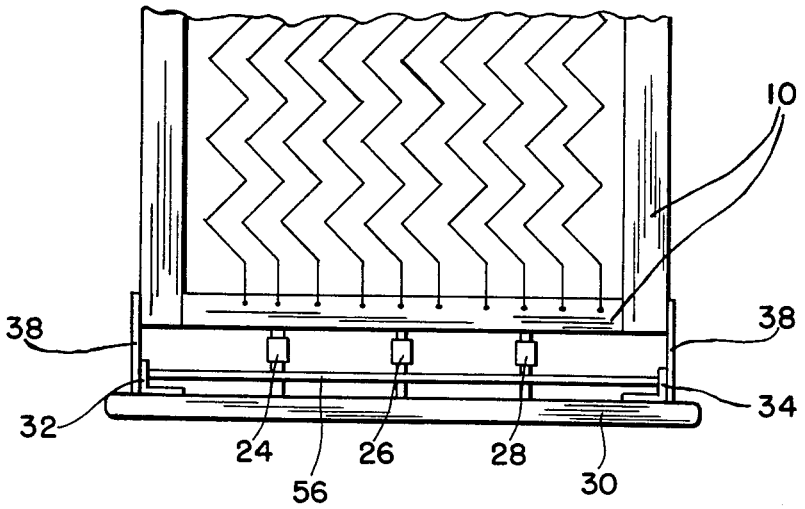
FIG. 2 is a plan view of FIG. 1.

Only so much of the nursing home bed is shown as is necessary to disclose the invention. This invention is essentially an appliance adapted to a conventional nursing home bed, except that the front bed posts or legs are preferably made of angle iron for convenient attachment of the novel device to the bed at its foot or forward end.

At the forward or foot end of the usual nursing home bed there are one or more, usually three, hand cranks for turning a like number of shafts that adjust the mattress at the head and knee areas and vertically as a whole. These cranks are usually dis-jointable for semi-detachment from the shafts to lie more or less out of the way or selectively to be operative to turn the cranks, but necessarily in a position wherein they extend out from the bed. Such position of the cranks is unsafe for passersby and more unsightly than when dis-jointed and dangling.

In the drawings, a mattress supporting spring frame is indicated generally at 10. The mattress is not shown. The spring frame has supporting legs, and those at the foot of the bed are angle irons 12, 14, or some similar member having a flat surface 16 parallel with the head to foot direction. Three ordinary hand cranks 18, 20, and 22 are attached to their respective shafts 24, 26, 28 by pivot yokes 25 as is well known, to selectively allow the cranks to dangle in inoperative condition and to be socketed in extended condition for rotation of the respective shafts.

The cranks are in plain sight of observers, and are unsightly. The observer is instantly aware that the bed is not a conventional bed but is a nursing home bed, giving a connotation of illness, which is undesirable.

A foot board 30 is provided to normally cover the foot end of the mattress, not shown, and the cranks and shafts. The foot board looks like any foot board, but has a pair of angle irons 32, 34 on its rear face at the ends thereof, these irons being vertical, parallel and spaced. A pair of links 36, 38, mounted to swing on spaced axes 40, 42, on bed post or leg 16, are in turn mounted to swing on pins 44, 46, at their opposite ends as on angle iron 32. Thus, the foot board 30 is mounted in vertical position, at each end to swing on the two pairs of links from a crank concealing lower position to a crank revealing upper position, shown in solid lines, upper position, and dotted lines, lower position, FIG. 3.

Figure 3:
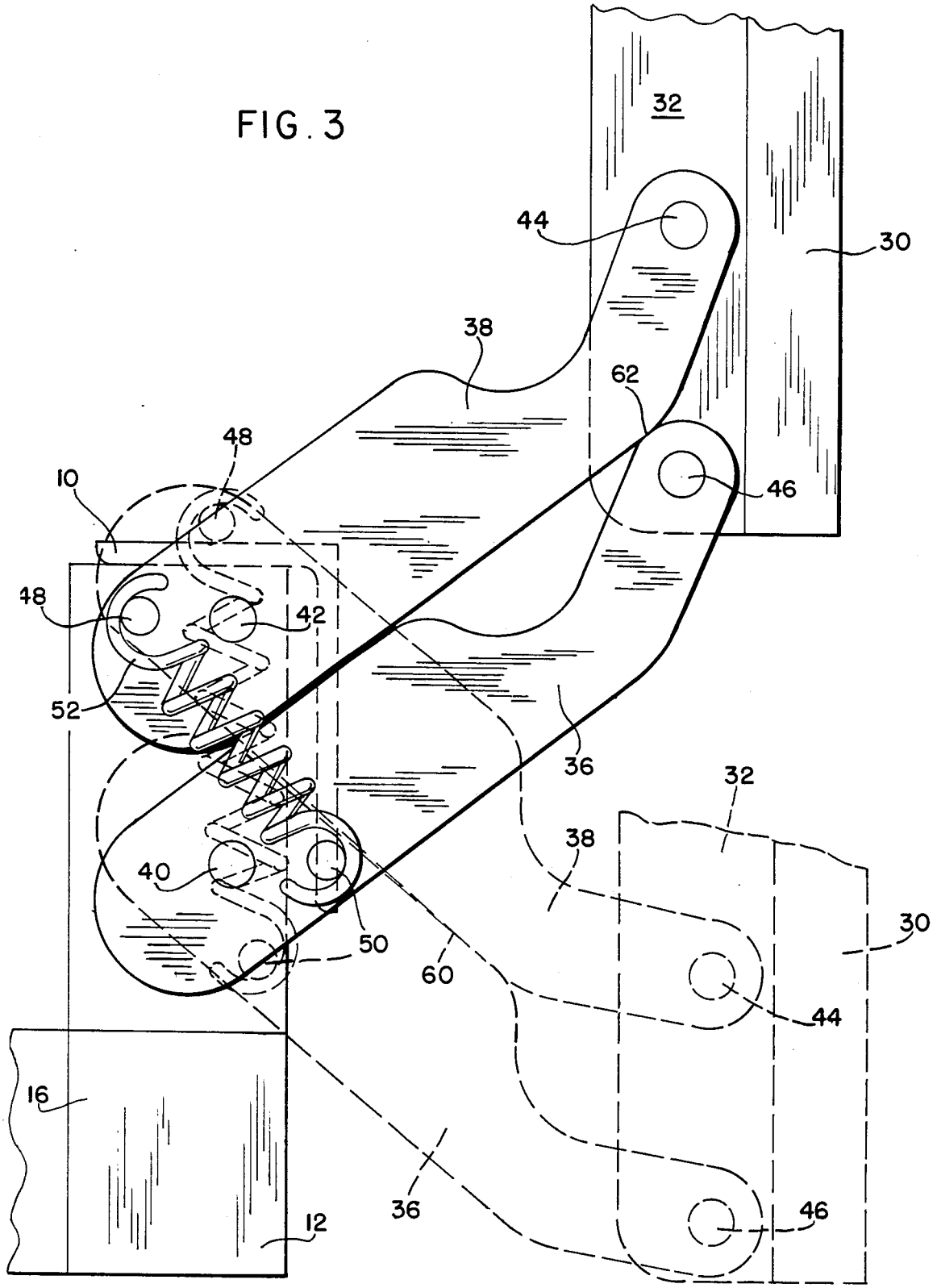
FIG. 3 is a side elevational view of the front end of the nursing home bed, looking in the direction of arrow 3 in FIG. 1, and showing the foot board in raised position in solid lines and in lowered position in broken lines.

Each link has a stud, as at 48, 50, to hold a tension spring 52 at its ends. The positions of these studs, and the respective spring (one at each end of the foot board) are shown in FIG. 3, and it is already apparent that the springs pass dead center, with respect to pivots 40 and 42, when the foot board is raised, and therefore, the latter is held in its up position until manually pushed down again to its crank concealing position wherein gravity holds it.

Figure 4:
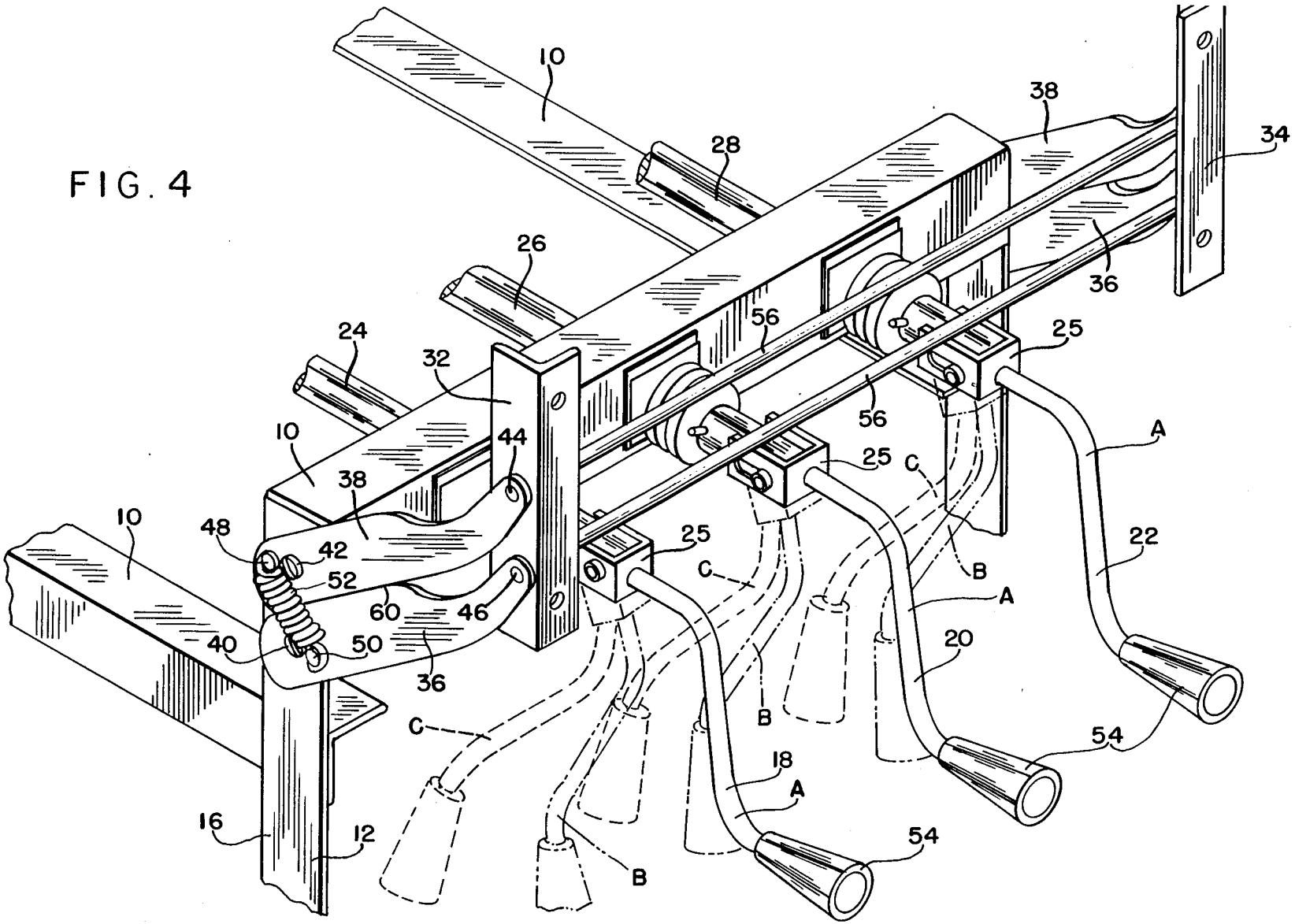
FIG. 4 is a perspective view of the three cranks and their three positions, and the construction of the foot board support.

The foot board is free to be given any dimensions desired, but normally it will allow some small glimpse of the handles 54 on the cranks even when down, at its lower edge. As will be seen, these handles are low in concealed position of the cranks, and will not be seen by a person nearby, but only are visible from a point about knee-high, and are thus substantially hidden. The cranks have three positions, FIG. 4, Position A in shaft joined operative position; Position B in dis-joined, dangling position; and Position C when engaged by the foot board and pivoted to the rear, concealed position. In B position, the cranks are merely under the influence of gravity, while in A position they are held up because they are socketed on the ends of the shafts 24, 26, 28 by pivot yokes 25. The pivots 44 may be located on the ends of a welded in cross rod 56 which contacts the dis-joined cranks as the foot board descends and pushes them back to C position, farther back than the B position, which would be normal if the cranks simply hung down due to gravity. Therefore, when the foot board is raised to provide access to the cranks, they swing down and forwardly, making it more apparent where they are and easier to grasp to re-engage them with the shafts for operation of the latter.

It will be seen that spring engaged studs 48 and 50 are separated to a greater degree with the links 36, 38 down and consequent down, concealment position of the foot board, than when these links are up. There is tension at all times, however, and the foot board is spring assisted from almost the start of motion up, and is held in up position until returned manually. At the same time, pins 48 and 50 are so close to a line between pivots 40 and 42, when the foot board is full down, that there is no tendency for the foot board to rise by itself, gravity being sufficient to hold it down once at the bottom of its travel. Although not really necessary, a hand hold 60 may be provided for ease in manually grasping the foot board to raise it.

I claim:

1. In a nursing home bed that includes a mattress support, a foot board, and at least one hand crank at the foot of the bed for adjusting the mattress support, wherein the foot board is a unitary one piece member without apertures therein nor extraneous parts, and has a bottom edge, said foot board being bodily movable between two separate positions in a vertical direction, relative to the support, means to movably support the foot board for motion between the two positions, means mounting the hand crank relative to the support, said last named means and the hand crank being concealed behind the foot board adjacent the said lower edge of the foot board in one position thereof, said hand crank being inaccessible, and the hand crank being visible and accessible in the other position of the foot board, below the lower edge of the foot board, and means to balance the foot board in its positions, whereby it is easily manually moved from either position to the other and temporarily so maintained.

2. The bed of claim 1 wherein said foot board supporting means includes movable means holding the foot board vertical.

3. The bed of claim 2 wherein the crank concealing position of the foot board is relatively low and the crank revealing position thereof is relatively higher, the motion of the foot board being constrained by the supporting means to a generally vertical path.

4. The bed of claim 3 wherein the supporting means comprises a pair of linkages, the linkages being interpivoted with respect to the foot board and to the bed, the generally vertical path including an arc due to the swinging motion of the linkages.

5. The bed of claim 4 wherein the crank is permanently connected to its mounting means but including mechanism whereby the crank may be disjointed from its mounting means to dangle, in substantially out of the way non-operative condition, and the path of the foot board intersects the dangling crank pushing it to the rear against gravity, whereby the dangling crank automatically moves to an accessible location upon removal of the foot board from its crank concealing position.

6. The nursing home bed of claim 4 wherein each linkage comprises a pair of links in parallelogram form, the links of each pair being coplanar and being arranged one above the other, said links engaging each other at thin contiguous edges when the linkage is pivoted down to stop the motion thereof and of the foot board.

7. The bed of claim 6 wherein the links engage the same edges in a different area to limit the upward motion thereof and of the foot board.

8. The bed of claim 6 including a tension spring for each pair of links, each spring being connected to its respective links relative to the points of interpivoting thereof with the bed, to tend to hold the links and foot board elevated.

* * * * *